US005194010A

United States Patent [19]

Dambach et al.

[11] Patent Number: 5,194,010

[45] Date of Patent: Mar. 16, 1993

[54] SURFACE MOUNT ELECTRICAL CONNECTOR ASSEMBLY

[75] Inventors: Philip J. Dambach, Naperville; Jerry A. Long, Elgin; Joseph W. Nelligan, Jr., LaGrange Park; Irvin R. Triner, Willowsprings; Henry Zielke, Hoffman Estates, all of Ill.

[73] Assignee: Molex Incorporated, Lisle, Ill.

[21] Appl. No.: 823,793

[22] Filed: Jan. 22, 1992

[51] Int. Cl.[5] ..... H01R 9/09

[52] U.S. Cl. ..... 439/79; 439/67; 439/77; 439/499

[58] Field of Search ..... 439/67, 77, 79, 493, 439/499

[56] References Cited

U.S. PATENT DOCUMENTS 4,861,272 8/1989 Clark ..... 439/79
4,894,015 1/1990 Stockero et al. ..... 439/67

FOREIGN PATENT DOCUMENTS 0112184 4/1990 Japan ..... 439/79

*Primary Examiner*—Paula A. Bradley
*Attorney, Agent, or Firm*—A. A. Tirva

[57] ABSTRACT

A surface mount electrical connector assembly is provided for electrically connecting a plurality of terminals of an electrical connector to circuit traces on a printed circuit board. The terminals are mounted on a dielectric housing of the connector and have contact ends exposed exteriorly on one side of the housing. A flexible circuit sheet is mounted on the side of the housing, with conductive circuit paths being electrically terminated to the contact ends of the terminals. The flexible circuit sheet has an edge for surface engaging the printed circuit board, with contact pads at the edge for electrical termination to the circuit traces on the printed circuit board.

14 Claims, 2 Drawing Sheets

SURFACE MOUNT ELECTRICAL CONNECTOR ASSEMBLY

FIELD OF THE INVENTION

This invention generally relates to the art of electrical connectors and, particularly, to a surface mount electrical connector assembly for electrically connecting a plurality of terminals of an electrical connector to circuit traces on a printed circuit board.

BACKGROUND OF THE INVENTION

Compact electronic equipment normally is assembled mechanically and requires high density and automatic mounting of various electronic components on a printed circuit board. Consequently, surface mount type electrical connectors have become important components in such electronic equipment.

Conventionally, a surface mount electrical connector includes a dielectric housing which is mounted to the printed circuit board and includes a plurality of terminals projecting out of one side of the housing. The terminals are bent downwardly in such a manner that leg portions or contact feet of the terminals may be soldered to the circuit traces on the printed circuit board.

One of the problems with surface mount connectors of the character described is that uneven or nonuniform contact forces often are created between the contact sections or terminal feet and the circuit traces on the printed circuit board. This is caused primarily because the terminals are individual or discrete components and it is difficult to maintain the contact sections or feet of the terminals in a coplanar array. Attempts have been made to solve this particular problem by establishing a "spring back" in the terminal legs, after forming, to resiliently bias the legs against a surface, thereby aligning the contact sections of the legs in the same plane and consequently ensuring that the feet of the legs are coplanar. However, such provisions are costly because of the requirement of separate steps in the manufacture of the connector, and the connector is made unnecessarily bulky because of the additional surfaces against which the legs are aligned.

Another problem with surface mount connectors having conventional stamped and formed terminals is that it is very difficult from manufacturing and assembly standpoint to align terminal ends which contact conductive traces on a printed circuit board in a single row on small centers.

This invention is directed to solving the above problems by using flexible circuitry which not only provides coplanar contact pads for engaging the circuit traces on the printed circuit board and aligns terminal ends in a single row, but the connector assembly itself can be maintained quite compact.

SUMMARY OF THE INVENTION

An object, therefore, of the invention is to provide a new and improved surface mount electrical connector assembly for electrically connecting a plurality of terminals of an electrical connector to circuit traces on a printed circuit board.

In the exemplary embodiment of the invention, the terminals of the connector are mounted in a dielectric housing and have contact ends exposed exteriorly on one side of the housing. A flexible circuit sheet is mounted on the side of the housing, with conductive paths on the flexible circuit sheet being electrically terminated to the contact ends of the terminals. The flexible circuit sheet has an edge for surface engaging the printed circuit board with contact pads at least near the edge for electrical termination to the circuit traces on the printed circuit board.

In the preferred embodiment of the invention, the contact ends of the terminals are in the form of tail portions projecting from the housing. The flexible circuit sheet includes a generally planar portion mounted on the side of the housing with holes therein for receiving the tail portions of the terminals. The conductive circuit paths on the flexible circuit sheet are soldered to the tail portions. The generally planar portion of the flexible circuit sheet also includes a plurality of locating holes for receiving locating pins projecting from the side of the housing. The flexible circuit sheet is heat staked to the housing at the locating pins.

As disclosed herein, an integral flange portion of the flexible circuit sheet is bent at an angle to the generally planar portion thereof and defining the edge which engages the printed circuit board. The conductive circuit paths are on a side of the flexible circuit sheet facing outwardly of the housing, and the contact pads are defined by portions of the conductive circuit paths wrapped around the bent edge of the sheet.

In an alternate form of the invention, the flexible circuit sheet has slits in the edge thereof between the contact pads.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings in which like reference numerals identify like elements in the figures and in which:

DETAILED DESCRIPTION OF THE PREFERRED EMBODIMENT

Figure 1:
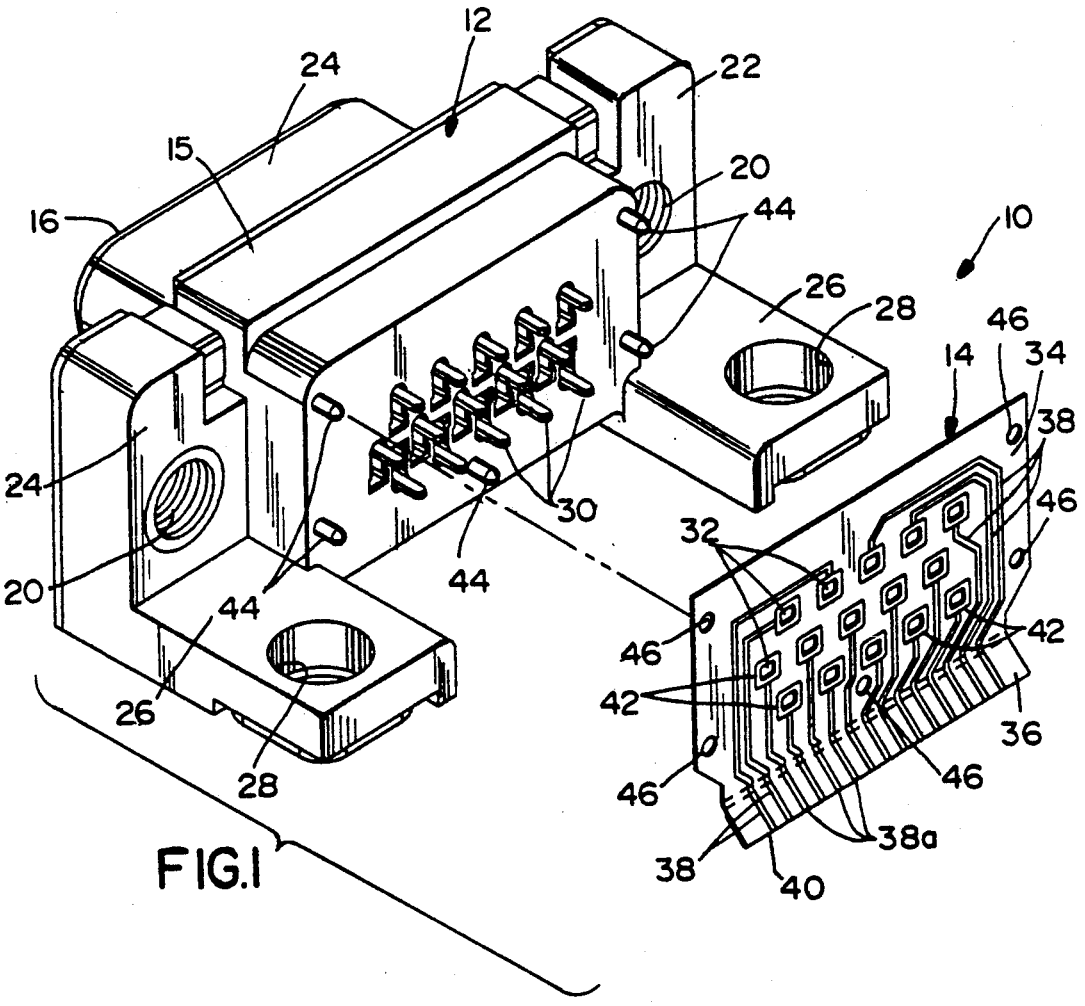
FIG. 1 is a perspective view of an electrical connector assembly embodying the concepts of the invention, with the flexible circuit sheet removed from the connector housing.

Referring to the drawings in greater detail, and first to FIG. 1, a surface mount electrical connector assembly, generally designated 10, is shown to include an electrical connector, generally designated 12, to which a flexible circuit sheet, generally designated 14, is mounted.

Electrical connector 12 includes a unitarily molded dielectric housing 15 fabricated of plastic or like material. The housing defines a mating end 16 and a terminating end or face 18 of the connector. Internally threaded rivets 2 extend through side wings 22 of the housing for receiving appropriate fastening means of a complementary electrical connector (not shown) which mates with connector assembly 10. A shield 24 surrounds the mating end of housing 15 of connector 12. A pair of rearwardly extending flanges 26 are provided with holes 28 for receiving mounting devices for surface mounting housing 15, connector 12 and connector assembly 10 to a printed circuit board, for instance.

A plurality of terminals (described in greater detail hereinafter) include tail portions 30 projecting rearwardly from terminating face 18 of housing 15. Flexible circuit sheet 14 has correspondingly located holes 32 therethrough for receiving tail portions 30, to electrically connect the tail portions to circuit traces on a printed circuit board.

More particularly, flexible circuit sheet 14 includes a generally planar portion 34 and an angled integral flange portion 36 along the bottom of the planar portion. The sheet includes a flexible dielectric substrate, and a plurality of conductive circuit paths 38 are printed onto planar portion 34 and extend into flange portion 36 to a linear edge 40 of the flexible circuit sheet. Conductive areas 42, integral with conductive circuit paths 38, surround holes 32 whereby terminal tail portions 30 can be soldered thereto.

In order to facilitate mounting flexible circuit sheet 14 onto terminating face 18 of connector housing 15, a plurality of locating pins 44 project outwardly from the terminating face for positioning in locating holes 46 in the generally planar portion 34 of the flexible circuit sheet.

Figure 2:
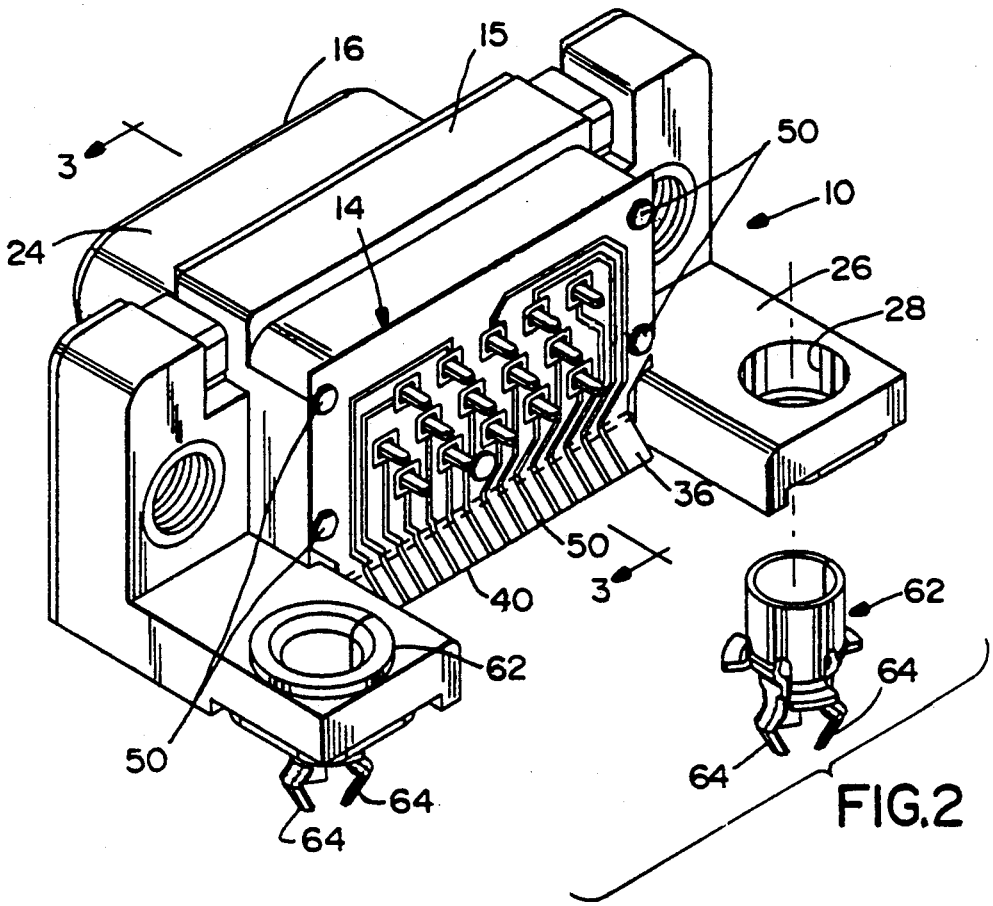
FIG. 2 is a perspective view similar to that of FIG. 1, with the flexible circuit sheet mounted to the connector housing, in conjunction with a pair of mounting devices for mounting the connector assembly to a printed circuit board.
Figure 3:
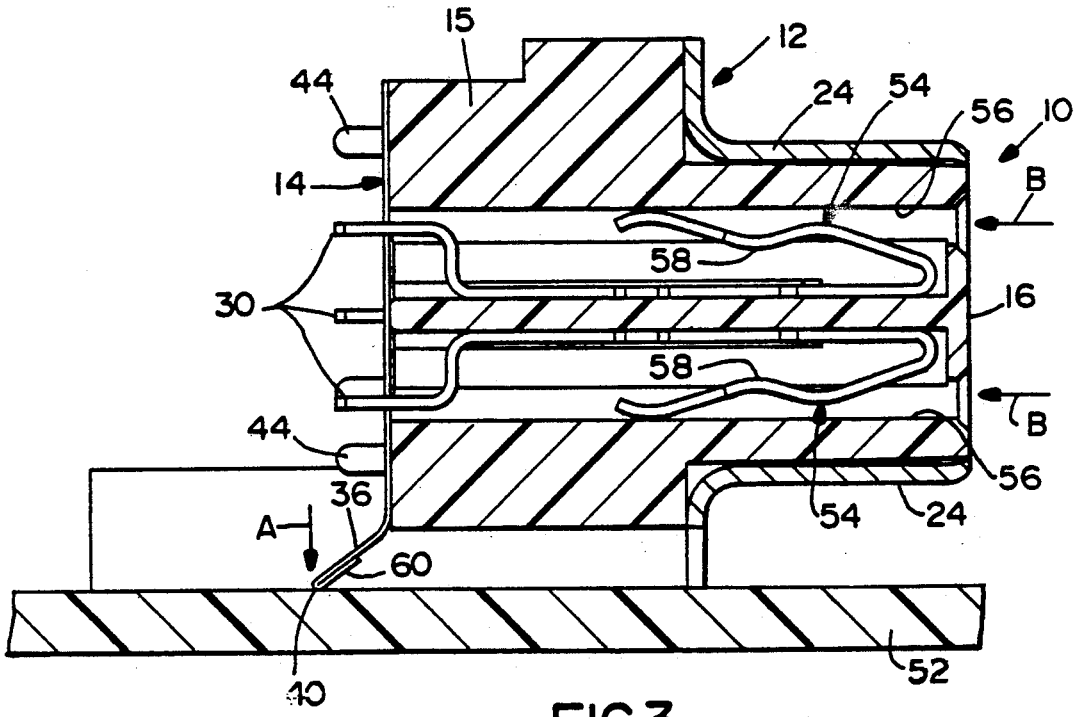
FIG. 3 is a vertical section taken generally along line 3—3 of FIG. 2.

In assembly, and referring to FIGS. 2 and 3 in conjunction with FIG. 1, flexible circuit sheet 14 is mounted to terminating face 18 of connector housing 15 by positioning planar portion 34 of the flexible circuit sheet such that locating pins 44 projecting from the terminating face extend through locating holes 46 in the flexible circuit sheet. The planar portion of the flexible circuit sheet is positioned tight and flush against the terminating face of connector housing 15, as seen in FIGS. 2 and 3, and locating pins 44 are heat staked, as at 50 in FIG. 2, to provide permanent stability and location for the flexible circuit sheet relative to connector 12 and housing 15. Once so located and assembled, linear edge 40 of the flexible circuit sheet 14 is coplanar with and engages a top surface of a printed circuit board 52 (FIG. 3). Originally, angled flange portion 36 of the flexible circuit sheet may be bent at a more acute angle than that shown in FIG. 3 such that a biasing force is generated against the printed circuit board in the direction of arrow "A". With the flexible circuit sheet being unitary, uniform forces are created along linear edge 40 of the sheet to establish uniform contact forces between contact pads 38*a* (FIG. 1) of conductive paths 38 and the appropriate circuit traces on printed circuit board 52.

While looking at FIG. 3, it can be noted that terminal tail portions 30 are part of terminals, generally designated 54, mounted in through passages 56 in housing 15 of connector 12. The terminals have spring arm portions 58 against which terminal pins of the complementary mating terminal are engaged as the terminal pins are inserted into through passages 56 in the direction of arrows "B". It also can be seen in FIG. 3 that shield 24 is in the form of a shroud substantially surrounding the mating end of connector 12.

As seen in FIG. 3, in the preferred embodiment of the invention, a feature of flexible circuit sheet 14 is to bend the sheet back onto itself, as at 60, along linear edge 40. Conductive circuit paths 38 continue around the edge of the sheet whereby contact pads 38*a* (FIG. 1) actually are wrapped around the bent edge of the sheet.

Referring back to FIG. 2, appropriate mounting devices, generally designated 62, may be provided for mounting surface mount electrical connector assembly 10 to printed circuit board 52. A variety of mounting devices can be employed, or mounting pegs actually can be integrally molded with rearwardly projecting flanges 26 of housing 15. In any event, mounting devices 62 include depending, hooked spring legs 64 for positioning into appropriate mounting holes in the printed circuit board.

Figure 4:
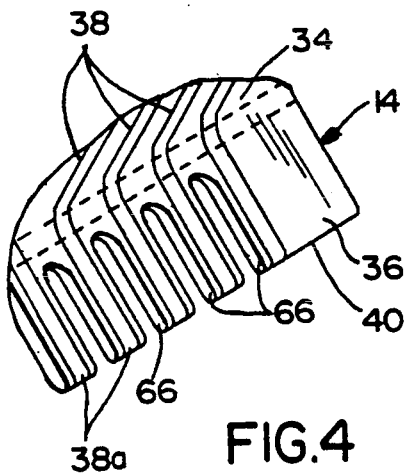
FIG. 4 is a fragmented perspective view, on an enlarged scale, of an edge section of an alternate form of flexible circuit sheet.

FIG. 4 shows an alternate feature of the invention involving printed circuit sheet 14. More particularly, the printed circuit sheet has a plurality of slits 66 cut or formed through linear edge 40 into angled flange portion 36 of the flexible circuit sheet. These slits give some independent flexing to contact pads 38*a* in order to accommodate some slight variations or irregularities in the surface of printed circuit board 52 to which the connector assembly is mounted. However, the slits do not detract from the fact that the flexible circuit sheet still maintains the contact pads in a linear or coplanar array which has become difficult and/or expensive to achieve in electrical connector assemblies of the prior art wherein the terminals or terminal legs which are connected to circuit traces on the printed circuit board, are discrete and independently flexible terminal components.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a surface mount electrical connector assembly for electrically connecting a plurality of terminals of an electrical connector to circuit traces on a printed circuit board, the terminals being mounted on a dielectric housing of the electrical connector and having contact ends exposed exteriorly on one side of the housing, the improvement comprising a flexible circuit sheet mounted on the housing with conductive circuit paths on the flexible circuit sheet being electrically terminated to the contact ends of the terminals, the flexible circuit sheet having an edge for surface engaging the printed circuit board with contact pads at least near the edge for electrical termination to the circuit traces on the printed circuit board and wherein said flexible circuit sheet includes a plurality of locating holes receiving locating pins projecting from the side of the housing.

2. In a surface mount electrical connector assembly as set forth in claim 1, wherein said flexible circuit sheet has a generally planar portion mounted on the housing and an integral flange portion at an angle to the planar portion and defining said edge.

3. In a surface mount electrical connector assembly as set forth in claim 1, wherein said flexible circuit sheet is heat staked to the housing at said locating pins.

4. In a surface mount electrical connector assembly as set forth in claim 1, wherein said flexible circuit sheet comprises a flexible dielectric substrate having the conductive circuit paths printed thereon.

5. In a surface mount electrical connector assembly as set forth in claim 1, wherein the contact ends of the terminals are in the form of tail portions projecting from the housing, and said flexible circuit sheet includes holes for receiving the tail portions.

6. In a surface mount electrical connector assembly as set forth in claim 5, wherein said conductive circuit paths on the flexible circuit sheet are soldered to the tail portions.

7. In a surface mount electrical connector assembly for electrically connecting a plurality of terminals of an electrical connector to circuit traces on a printed circuit board, the terminals being mounted on a dielectric housing of the electrical connector and having contact ends exposed exteriorly on one side of the housing, the improvement comprising a flexible circuit sheet mounted on the housing with conductive circuit paths on the flexible circuit sheet being electrically terminated to the contact ends of the terminals, the flexible circuit sheet having an edge for surface engaging the printed circuit board with contact pads at least near the edge for electrical termination to the circuit traces on the printed circuit board wherein said flexible circuit sheet includes slits in said edge between the contact pads.

8. In a surface mount electrical connector assembly for electrically connecting a plurality of terminals of an electrical connector to circuit traces on a printed circuit board, the terminals being mounted on a dielectric housing of the electrical connector and having contact ends exposed exteriorly on one side of the housing, the improvement comprising a flexible circuit sheet mounted on the housing with conductive circuit paths on the flexible circuit sheet being electrically terminated to the contact ends of the terminals, the flexible circuit sheet having an edge for surface engaging the printed circuit board with contact pads at least near the edge for electrical termination to the circuit traces on the printed circuit board wherein the conductive circuit paths on the flexible circuit sheet are on a side thereof facing outwardly of the housing, and the sheet is bent back onto itself along said edge, whereby said contact pads are defined by portions of the conductive circuit paths wrapped around the bent edge of the sheet.

9. In a surface mount electrical connector assembly for electrically connecting a plurality of terminals of an electrical connector to circuit traces on a printed circuit board, the terminals being mounted on a dielectric housing of the electrical connector and having contact ends exposed exteriorly on one side of the housing, the improvement comprising a flexible circuit sheet mounted on the housing with conductive circuit paths on the flexible circuit sheet being electrically terminated to the contact ends of the terminals, the flexible circuit sheet having an edge for surface engaging the printed circuit board with contact pads at least near the edge for electrical termination to the circuit traces on the printed circuit board wherein the flexible circuit sheet is bent back onto itself along said edge, and said contact pads are on a side of the flexible circuit sheet so that the conductive circuit paths wrap around the bent edge of the sheet.

10. In a surface mount electrical connector assembly for electrically connecting a plurality of terminals of an electrical connector to circuit traces on a printed circuit board, the terminals being mounted on a dielectric housing of the electrical connector and having contact ends exposed exteriorly on one side of the housing, the improvement comprising said contact ends of the terminals being in the form of tail portions projecting from the housing, the housing including a plurality of locating pins projecting from said side thereof, and including a flexible circuit sheet having a generally planar portion mounted to said side of the housing, the planar portion including first holes for receiving the tail portions of the terminals and second holes for receiving the locating pins projecting from the side of the housing, the flexible circuit sheet including a flange portion integral with the planar portion and at an angle thereto defining a linear edge for surface engaging the printed circuit board, and including conductive circuit paths on the planar portion, the paths having terminating ends for electrical connection to the terminal tails and contact ends at said linear edge for electrical termination to circuit traces on the printed circuit board.

11. In a surface mount electrical connector assembly as set forth in claim 10, wherein the terminating ends of the conductive circuit paths are soldered to the tail portions of the terminals.

12. In a surface mount electrical connector assembly as set forth in claim 10, wherein said flexible circuit sheet is heat staked to the housing at said locating pins.

13. In a surface mount electrical connector assembly as set forth in claim 10, wherein said flexible circuit sheet includes slits in said edge between the contact pads.

14. In a surface mount electrical connector assembly as set forth in claim 10, wherein the conductive circuit paths on the flexible circuit sheet are on a side thereof facing outwardly of the housing, and the sheet is bent back onto itself along said edge, whereby said contact pads are defined by portions of the conductive circuit paths wrapped around the bent edge of the sheet.

* * * * *